US011567424B2

(12) United States Patent
Kaneko et al.

(10) Patent No.: US 11,567,424 B2
(45) Date of Patent: Jan. 31, 2023

(54) IMAGE FORMING APPARATUS THAT ESTIMATES DETERIORATION STATUS OF CLEANING BLADE ACCORDING TO CURRENT RATIO

(71) Applicant: KYOCERA Document Solutions Inc., Osaka (JP)

(72) Inventors: Shiro Kaneko, Osaka (JP); Hiroka Itani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/470,866

(22) Filed: Sep. 9, 2021

(65) Prior Publication Data

US 2022/0075285 A1 Mar. 10, 2022

(30) Foreign Application Priority Data

Sep. 10, 2020 (JP) ..... JP2020-152060

(51) Int. Cl.

| | |
|---|---|
| ***G03G 15/09*** | (2006.01) |
| ***G03G 15/06*** | (2006.01) |
| ***G03G 15/095*** | (2006.01) |
| ***G03G 21/00*** | (2006.01) |
| ***G03G 15/00*** | (2006.01) |

(52) U.S. Cl.

CPC ..... *G03G 15/065* (2013.01); *G03G 15/095* (2013.01); *G03G 15/0907* (2013.01); *G03G 15/553* (2013.01); *G03G 21/0011* (2013.01)

(58) Field of Classification Search

CPC ..... G03G 15/065; G03G 15/095; G03G 21/0011; G03G 15/553; G03G 15/0907; G03G 2221/1663; G03G 2221/0089

See application file for complete search history.

(56) References Cited

FOREIGN PATENT DOCUMENTS

JP 2010-026122 A 2/2010

*Primary Examiner* — Arlene Heredia
*Assistant Examiner* — Laura Roth
(74) *Attorney, Agent, or Firm* — IP Business Solutions, LLC

(57) ABSTRACT

An image forming apparatus includes an image carrier, a developing device, a voltage applier, a current detector, a cleaning blade, and a control device. The control device acts as a measurer and an estimator. The measurer changes the DC bias to a first value and a second value, and acquires a first magnitude of the developing current corresponding to the first value, and a second magnitude of the developing current corresponding to the second value, from the current detector. The estimator calculates a current ratio between the first magnitude and the second magnitude, and estimates deterioration status of the cleaning blade, according to the value of the current ratio.

9 Claims, 10 Drawing Sheets

IMAGE FORMING APPARATUS THAT ESTIMATES DETERIORATION STATUS OF CLEANING BLADE ACCORDING TO CURRENT RATIO

INCORPORATION BY REFERENCE

This application claims priority to Japanese Patent Application No. 2020-152060 filed on Sep. 10, 2020, the entire contents of which are incorporated by reference herein.

BACKGROUND

The present disclosure relates to an image forming apparatus.

In general, existing image forming apparatuses include a photoconductor drum, a cleaning blade, and a control device. The control device estimates a distribution of slipperiness of the cleaning blade, with respect to the photoconductor drum in the axial direction thereof, on the basis of load variation during the rotation of the photoconductor drum, when a residual object on the surface of the photoconductor drum is being removed by the cleaning blade. According to the estimation result, a developing toner is supplied to a position where the slipperiness is low, so that the distribution of slipperiness is uniformized.

SUMMARY

The disclosure proposes further improvement of the foregoing techniques.

In an aspect, the disclosure provides an image forming apparatus including an image carrier, a developing device, a voltage applier, a current detector, a cleaning blade, and a control device. The image carrier carries an electrostatic latent image. The developing device includes a developing agent carrier that carries a developing agent at least containing toner. The voltage applier applies a bias voltage including a DC bias and an AC bias, to the developing agent carrier, to cause the toner to migrate from the developing agent carrier to the image carrier. The current detector measures developing current flowing between the developing agent carrier and the image carrier. The cleaning blade is located in contact with the image carrier, to remove residual toner on the image carrier after a toner image is transferred. The control device includes a processor, and acts as a measurer and an estimator. The measurer changes the DC bias to a first value and a second value, and acquires a first magnitude of the developing current corresponding to the first value, and a second magnitude of the developing current corresponding to the second value, from the current detector. The estimator calculates a current ratio between the first magnitude and the second magnitude, and estimates deterioration status of the cleaning blade, according to a value of the current ratio.

DETAILED DESCRIPTION

Figure 1:
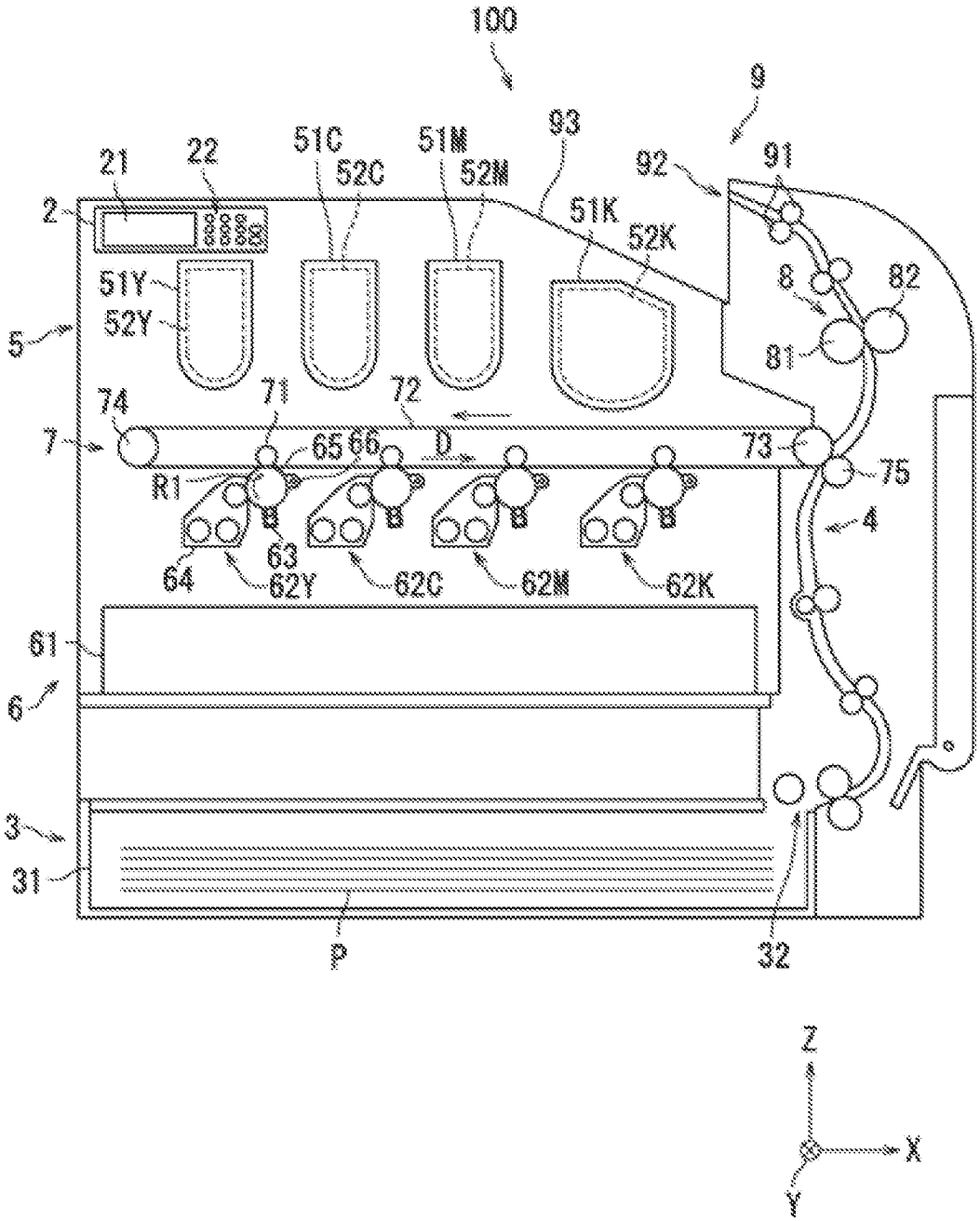
FIG. 1 is a schematic cross-sectional view showing an example of an image forming apparatus.

Hereafter, an embodiment of the disclosure will be described, with reference to the drawings. In the drawings, the same or corresponding elements are given the same numeral, and the description of such elements will not be repeated.

Referring to FIG. 1, an image forming apparatus 100 according to the embodiment of the disclosure will be described. FIG. 1 is a schematic cross-sectional view showing an example of the image forming apparatus. The image forming apparatus 100 is, for example, a color printer. For the sake of convenience in description, a left-right direction in FIG. 1 will be defined as X-direction, a depth direction will be defined as Y-direction, and an up-down direction will be defined as Z-direction.

As shown in FIG. 1, the image forming apparatus 100 includes an operation device 2, a paper feeding device 3, a transport device 4, a toner supply device 5, an image forming device 6, a transfer device 7, a fixing device 8, and a delivery area 9.

The operation device 2 receives instructions from a user. The operation device 2 includes an LCD 21 and a plurality of operation keys 22. The LCD 21 displays, for example, various processing results. The operation keys 22 include a tenkey, a start key, and so forth.

The paper feeding device 3 includes a paper cassette 31, and a feed roller group 32. The paper cassette 31 can accommodate therein a plurality of sheets P. The feed roller group 32 delivers the sheets P one by one from the paper cassette 31, to the transport device 4.

The transport device 4 includes rollers and guide members. The transport device 4 extends from the paper feeding device 3 to the delivery area 9. The transport device 4 transports the sheet P from the paper feeding device 3 to the delivery area 9, by way of the image forming device 6 and the fixing device 8.

The toner supply device 5 supplies the toner to the image forming device 6. The toner supply device 5 includes a first mounting base 51Y, a second mounting base 51C, a third mounting base 51M, and a fourth mounting base 51K.

On the first mounting base 51Y, a first toner container 52Y is mounted. Likewise, a second toner container 52C is mounted on the second mounting base 51C, a third toner container 52M is mounted on the third mounting base 51M, and a fourth toner container 52K is mounted on the fourth mounting base 51K. The first mounting base 51Y to the fourth mounting base 51K have the same configuration, except that different toner containers are mounted thereon.

The first toner container 52Y, the second toner container 52C, the third toner container 52M, and the fourth toner container 52K are each configured to accommodate the toner therein. In this embodiment, the first toner container 52Y accommodates yellow toner. The second toner container 52C accommodates cyan toner. The third toner container 52M accommodates magenta toner. The fourth toner container 52K accommodates black toner.

The image forming device 6 includes an exposure device 61, a first image forming unit 62Y, a second image forming unit 62C, a third image forming unit 62M, and a fourth image forming unit 62K.

The first image forming unit 62Y to the fourth image forming unit 62K each include a charging device 63, a developing device 64, a photoconductor drum 65, and a cleaning device 66. The photoconductor drum 65 exemplifies the "image carrier" in the disclosure.

The charging device 63, the developing device 64, and the cleaning device 66 are located along the circumferential surface of the photoconductor drum 65. In this embodiment, the photoconductor drum 65 rotates in the direction indicated by an arrow R1 in FIG. 1 (clockwise).

The charging device 63 uniformly charges, by electric discharge, the photoconductor drum 65 to a predetermined polarity. In this embodiment, the charging device 63 charges the photoconductor drum 65 to the positive polarity. The exposure device 61 emits a laser beam to the photoconductor drum 65 charged as above. As result, an electrostatic latent image is formed on the surface of the photoconductor drum 65.

The developing device 64 develops the electrostatic latent image formed on the surface of the photoconductor drum 65, thereby forming a toner image. The toner is supplied from the toner supply device 5, to the developing device 64. The developing device 64 applies the toner supplied from the toner supply device 5, to the surface of the photoconductor drum 65. As result, the toner image is formed on the surface of the photoconductor drum 65.

In this embodiment, the developing device 64 in the first image forming unit 62Y is connected to the first mounting base 51Y. Accordingly, the yellow toner is supplied to the developing device 64 in the first image forming unit 62Y. On the surface of the photoconductor drum 65 of the first image forming unit 62Y, a yellow toner image is formed.

The developing device 64 in the second image forming unit 62C is connected to the second mounting base 51C. Accordingly, the cyan toner is supplied to the developing device 64 in the second image forming unit 62C. On the surface of the photoconductor drum 65 of the second image forming unit 62C, a cyan toner image is formed.

The developing device 64 in the third image forming unit 62M is connected to the third mounting base 51M. Accordingly, the magenta toner is supplied to the developing device 64 in the third image forming unit 62M. On the surface of the photoconductor drum 65 of the third image forming unit 62M, a magenta toner image is formed.

The developing device 64 in the fourth image forming unit 62K is connected to the fourth mounting base 51K. Accordingly, the black toner is supplied to the developing device 64 in the fourth image forming unit 62K. On the surface of the photoconductor drum 65 of the fourth image forming unit 62K, a black toner image is formed.

The transfer device 7 superposes the respective toner images formed on the surface of the photoconductor drum 65 of the first image forming unit 62Y to the fourth image forming unit 62K, and transfers the superposed the toner images to the sheet P In this embodiment, the transfer device 7 transfers the superposed toner images to the sheet P, through a secondary transfer process. To be more detailed, the transfer device 7 includes four primary transfer rollers 71, an intermediate transfer belt 72, a drive roller 73, a follower roller 74, and a secondary transfer roller 75.

The intermediate transfer belt 72 is an endless belt stretched around the four primary transfer rollers 71, the drive roller 73, and the follower roller 74. The intermediate transfer belt 72 is driven by the rotation of the drive roller 73. In FIG. 1, the intermediate transfer belt 72 rotates counterclockwise. The follower roller 74 is made to rotate by the movement of the intermediate transfer belt 72.

The first image forming unit 62Y to the fourth image forming unit 62K are opposed to the lower surface of the intermediate transfer belt 72, and aligned along the moving direction D thereof. In this embodiment, the first image forming unit 62Y to the fourth image forming unit 62K are aligned in this order, from the upstream side toward the downstream side in the moving direction D of the lower surface of the intermediate transfer belt 72.

The primary transfer rollers 71 are each opposed to the photoconductor drum 65 via the intermediate transfer belt 72, and pressed against the photoconductor drum 65. Therefore, the toner image formed on the surface of each of the photoconductor drums 65 is sequentially transferred to the intermediate transfer belt 72. In this embodiment, the yellow toner image, the cyan toner image, the magenta toner image, and the black toner image are superposed and transferred in this order, onto the intermediate transfer belt 72.

The cleaning devices 66 respectively provided for the first image forming unit 62Y to the fourth image forming unit 62K serve to remove the residual toner on the photoconductor drum 65, remaining after the toner image is transferred to the intermediate transfer belt 72.

The secondary transfer roller 75 is opposed to the drive roller 73, via the intermediate transfer belt 72. The secondary transfer roller 75 is pressed against the drive roller 73. Accordingly, a transfer nip is defined between the secondary transfer roller 75 and the drive roller 73. When the sheet P passes the transfer nip, the toner images superposed on the intermediate transfer belt 72 are transferred to the sheet P The sheet P having the toner images transferred thereto is transported by the transport device 4, toward the fixing device 8.

The fixing device 8 includes a heating member 81 and a pressing member 82. The heating member 81 and the pressing member 82 are opposed to each other, so as to define a fixing nip. The sheet P transported from the image forming device 6 is heated at a predetermined fixing temperature under a pressure, while passing the fixing nip. As result, the toner image is fixed to the sheet P The sheet P is transported by the transport device 4, from the fixing device 8 to the delivery area 9.

The delivery area 9 includes a delivery roller pair 91 and an output tray 93. The delivery roller pair 91 delivers the sheet P to the output tray 93, through a delivery port 92. The delivery port 92 is located on the upper side of the image forming apparatus 100.

Figure 2:
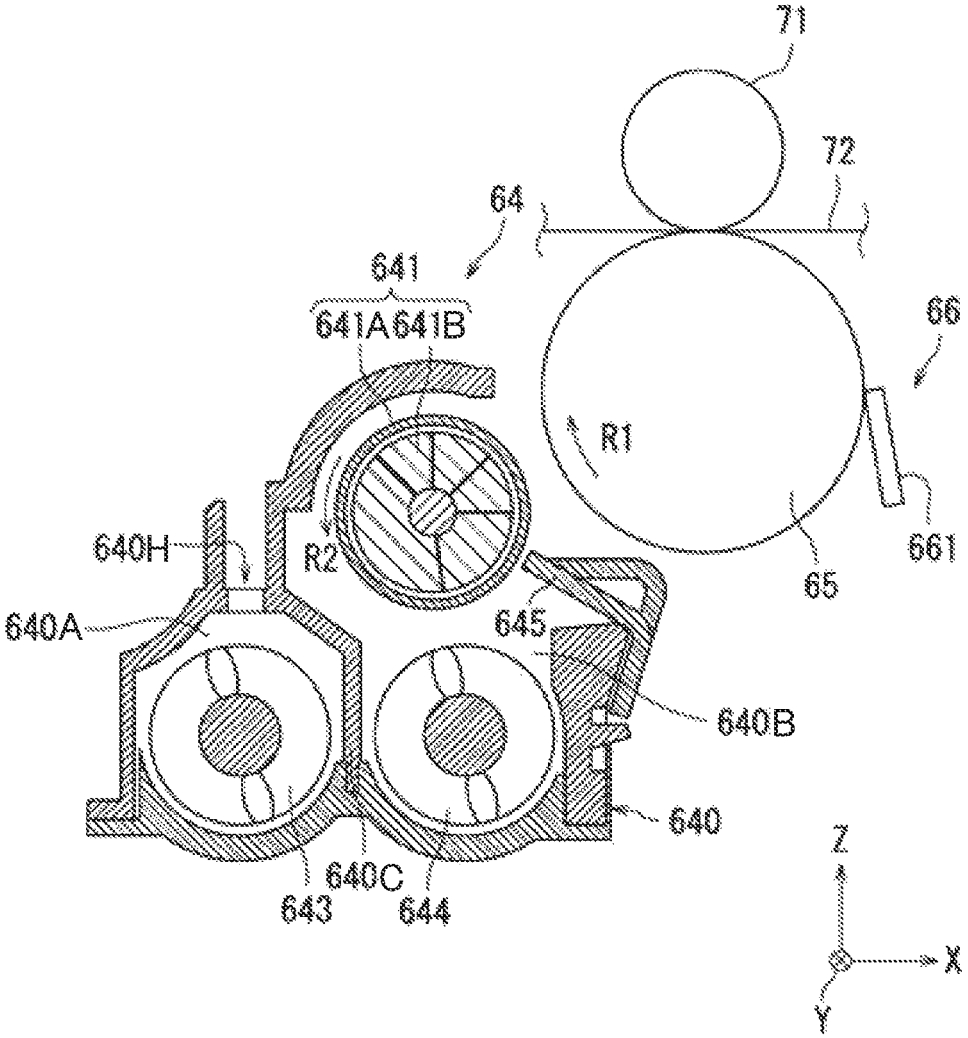
FIG. 2 is an enlarged cross-sectional view showing a detailed configuration of a developing device.

Referring to FIG. 1 and FIG. 2, the configuration of the developing device 64 will be described, in further detail. FIG. 2 is an enlarged cross-sectional view showing the detailed configuration of the developing device 64. In FIG. 2, the charging device 63 is not shown.

In this embodiment, as shown in FIG. 2, the developing device 64 includes a developing container 640 in which a two-component developing agent is stored. The developing device 64 includes, inside the developing container 640, a developing roller 641, a first mixing screw 643, a second mixing screw 644, and a blade 645. To be more detailed, the developing roller 641 is opposed to the second mixing screw 644. The blade 645 is opposed to the developing roller 641. The developing roller 641 exemplifies the "developing agent carrier" in the disclosure.

The developing container 640 is divided into a first mixing chamber 640A and a second mixing chamber 640B, by a partition wall 640C. The partition wall 640C extends in the axial direction of the developing roller 641 (Y-direction in FIG. 2). The first mixing chamber 640A and the second mixing chamber 640B communicate with each other, through an outer region of the end portions of the partition wall 640C in the longitudinal direction.

In the first mixing chamber 640A, the first mixing screw 643 is provided. In the first mixing chamber 640A, a magnetic carrier is stored. To the first mixing chamber 640A, a non-magnetic toner is supplied through a toner inlet 640H.

In the second mixing chamber 640B, the second mixing screw 644 is provided. In the second mixing chamber 640B, the magnetic carrier is stored.

The toner is stirred by the first mixing screw 643 and the second mixing screw 644, thus to be mixed with the carrier. As result, the two-component developing agent composed of the carrier and the toner is formed. The two-component developing agent exemplifies the "developing agent" in the disclosure.

The first mixing screw 643 and the second mixing screw 644 circulate and stir the developing agent, between the first mixing chamber 640A and the second mixing chamber 640B. As result, the toner is charged to a predetermined polarity. In this embodiment, the toner is positively charged.

The developing roller 641 includes a non-magnetic rotary sleeve 641A and a magnetic body 641B. The magnetic body 641B is fixed inside the rotary sleeve 641A. The magnetic body 641B includes a plurality of magnetic poles. The developing agent is adsorbed to the developing roller 641, by the magnetic force of the magnetic body 641B. As result, a magnetic brush is formed on the surface of the developing roller 641.

In this embodiment, the developing roller 641 rotates in the direction indicated by an arrow R2 in FIG. 2 (counter-clockwise). The developing roller 641 transports, by rotating, the magnetic brush to the position opposite the blade 645. The blade 645 is located so as to define a gap between the blade 645 and the developing roller 641. Accordingly, the thickness of the magnetic brush is defined by the b blade 645. The blade 645 is located on the upstream side in the rotating direction of the developing roller 641, with respect to the position where the developing roller 641 and the photoconductor drum 65 are opposed to each other.

A predetermined voltage is applied to the developing roller 641. Accordingly, the developing agent layer formed on the surface of the developing roller 641 is transported to the position opposite the photoconductor drum 65, and the toner in the developing agent adheres to the photoconductor drum 65.

The cleaning device 66 includes a cleaning blade 661 located in contact with the photoconductor drum 65. The cleaning blade 661 is, for example, made of rubber. The cleaning blade 661 is located downstream of the position where the primary transfer roller 71 and the photoconductor drum 65 are opposed to each other, in the rotating direction of the photoconductor drum 65.

Figure 3:
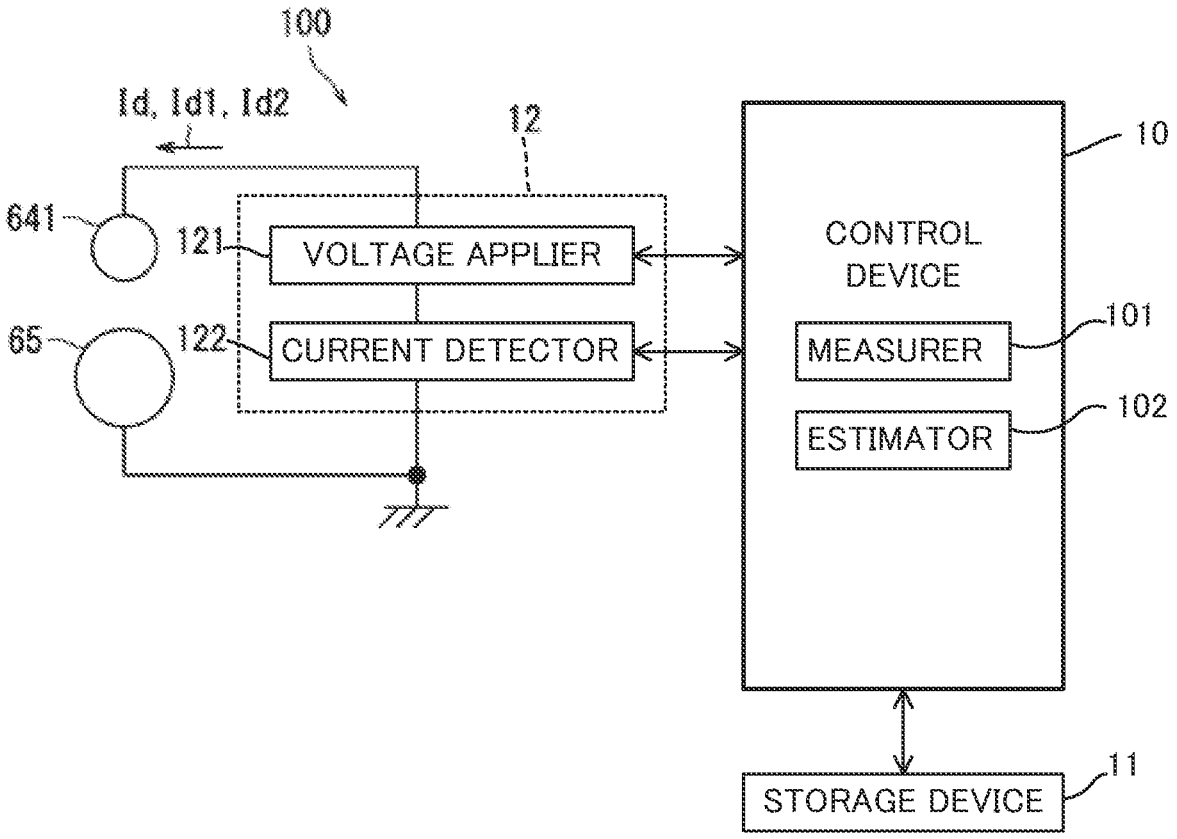
FIG. 3 is a block diagram showing an example of a circuit configuration of the image forming apparatus.

Referring now to FIG. 1 to FIG. 3, a circuit configuration of the image forming apparatus 100 will be described hereunder. FIG. 3 is a block diagram showing an example of the circuit configuration of the image forming apparatus 100.

As shown in FIG. 3, the image forming apparatus 100 includes a control device 10, a storage device 11, and a high-voltage applying substrate 12, in addition to the photoconductor drum 65 and the developing roller 641.

The storage device 11 includes memory units. In the storage device 11, various types of data and computer programs are stored. The storage device 11 includes a main memory unit such as a semiconductor memory, and an auxiliary memory unit such as a hard disk drive.

The control device 10 includes a processor, for example a central processing unit (CPU). The control device 10 controls the components of the image forming apparatus 100, by executing the computer program stored in the storage device 11. More specifically, the control device 10 acts as a first measurer 101, a second measurer 102, and an estimator 103, by executing the computer program stored in the storage device 11.

The high-voltage applying substrate 12 includes a voltage applier 121 and a current detector 122. The voltage applier 121 applies a bias voltage to the developing roller 641, to cause the toner to migrate from the developing roller 641 to the photoconductor drum 65. The bias voltage refers to a voltage in which an AC bias is superposed on a DC bias. The current detector 122 is an ammeter for measuring a developing current Id, flowing between the developing roller 641 and the photoconductor drum 65.

The measurer 101 controls the operation of the voltage applier 121 and the current detector 122, and measures the developing current Id. The control device 10 controls the exposure device 61, in the measurement mode of the developing current Id, so as to form an electrostatic latent image representing a rectangular patch pattern having a predetermined area, on the photoconductor drum 65.

The estimator 102 changes the DC bias Vdc to a first value Vdc1 and a second value Vdc2. The estimator 102 calculates a current ratio R, indicating a ratio between a first magnitude Id1 of the developing current Id corresponding to the first value Vdc1, and a second magnitude Id2 of the developing current Id corresponding to the second value Vdc2. Further, the estimator 102 estimates the deterioration status of the cleaning blade 661, according to the value of the current ratio R calculated as above.

The estimator 102 changes the value of the AC bias Vac, while maintaining the first value Vdc1 and the second value Vdc2, and acquires a specific value Vx of the AC bias Vac that makes the current ratio R maximum. The estimator 102 sets the AC bias Vac, to be used for the estimation of the deterioration status of the cleaning blade 661, to the specific value Vx.

The estimator 102 generates a prediction curve C indicating a predicted change with time, of the value of the current ratio R, and determines a next status estimation timing of the cleaning blade 661, on the basis of the prediction curve C.

The estimator 102 updates the prediction curve C, when the value of the current ratio R acquired after generating the prediction curve C is deviated from the prediction curve C.

The estimator 102 compares between the value of the current ratio R and a first threshold X1, and calculates, when the value of the current ratio R is equal to or smaller than the first threshold X1, the current ratio R with respect to each of a plurality of sections defined by dividing the photoconductor drum 65. The estimator 102 compares between the value of the current ratio R of each of the plurality of sections and a second threshold X2 smaller than the first threshold X1, and outputs a warning about the service life of the cleaning blade 661, when the value of the current ratio R is larger than the second threshold X2, with respect to all of the plurality of sections.

The estimator 102 compares between the value of the current ratio R and the first threshold X1, and calculates, when the value of the current ratio R is equal to or smaller than the first threshold X1, the current ratio R with respect to each of the plurality of sections defined by dividing the photoconductor drum 65. The estimator 102 compares between the value of the current ratio R of each of the plurality of sections and the second threshold X2 smaller than the first threshold X1, and outputs a recommendation to replace the cleaning blade 661, when the value of the current ratio R of any of the plurality of sections is equal to or smaller than the second threshold X2.

For example, the direction of the developing current Id flowing from the developing roller 641 to the photoconductor drum 65 will be defined as positive direction of the developing current Id. When a potential difference between the DC bias Vdc of the developing roller 641 and a surface potential V0 of the photoconductor drum 65 after the exposure (Vdc−V0) is positive, a forward bias is given between the developing roller 641 and the photoconductor drum 65. When the potential difference (Vdc−V0) is negative, a reverse bias is given between the developing roller 641 and the photoconductor drum 65.

The first value Vdc1 of the DC bias Vdc is, for example, determined so as to make the potential difference (Vdc−V0) positive. Accordingly, the first magnitude Id1 of the developing current Id is positive. The second value Vdc2 of the DC bias Vdc is, for example, determined so as to make the potential difference (Vdc−V0) negative. Accordingly, the second magnitude Id2 of the developing current Id is negative. The current ratio R is, for example, the absolute value of Id1/Id2.

When the cleaning blade 661 is deteriorated, to such an extent that the removal performance of the residual toner on the surface of the photoconductor drum 65 declines, the first magnitude Id1 of the developing current Id is reduced, though the first value Vdc1 of the DC bias Vdc remains unchanged. This is because the flight of the toner of the positive polarity from the developing roller 641 is disturbed by the residual toner of the positive polarity, on the photoconductor drum 65. Further, when the removal performance of the residual toner on the surface of the photoconductor drum 65 declines, owing to the deterioration of the cleaning blade 661, the absolute value of the second magnitude Id2 of the developing current Id is increased, though the second value Vdc2 of the DC bias Vdc remains unchanged. This is because the residual toner of the positive polarity, on the surface of the photoconductor drum 65, is returned to the developing roller 641, by the reverse bias. Therefore, it can be predicted that the current ratio R is reduced, when the cleaning blade 661 is deteriorated.

Figure 4:
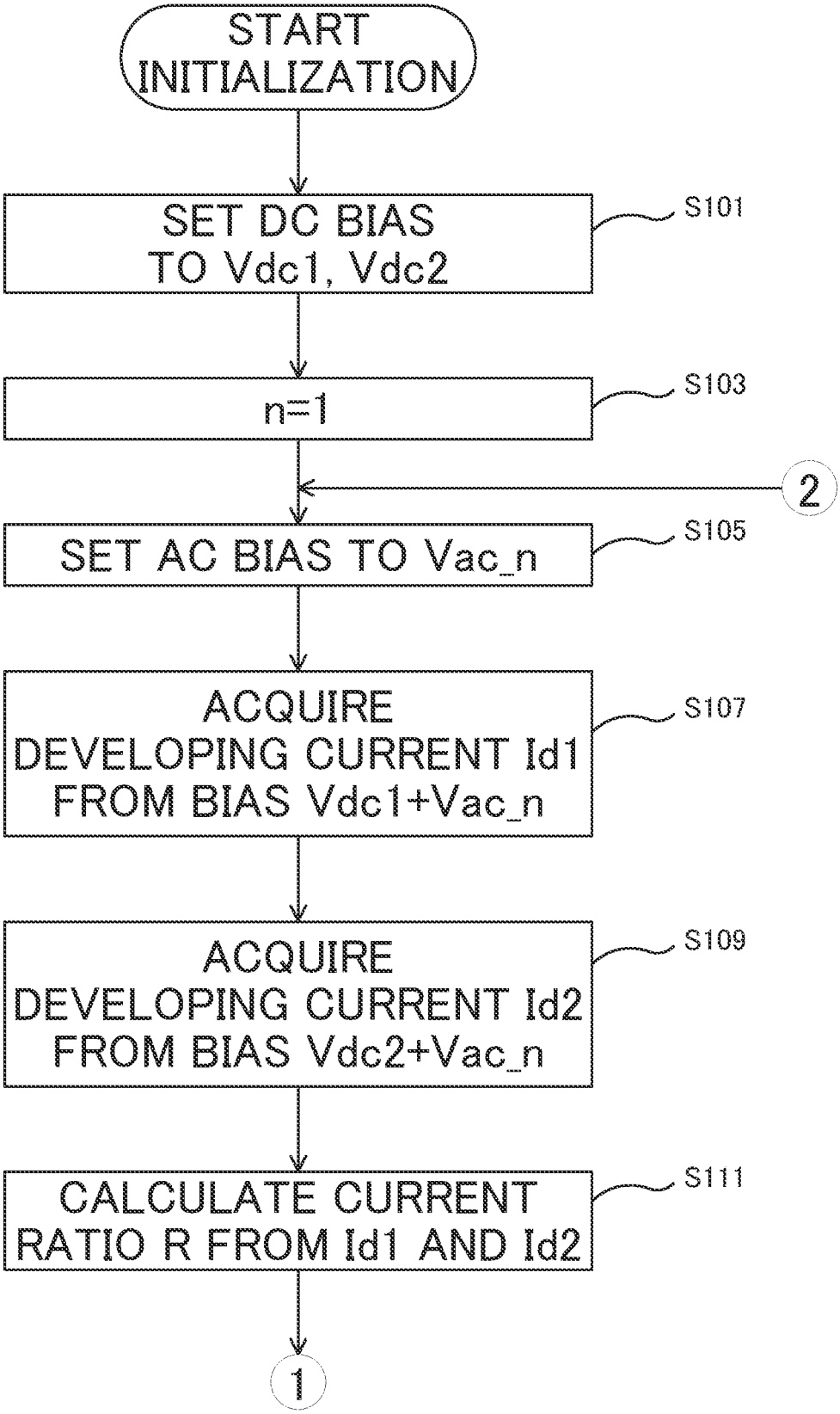
FIG. 4 is a flowchart showing an example of an initialization process.
Figure 5:
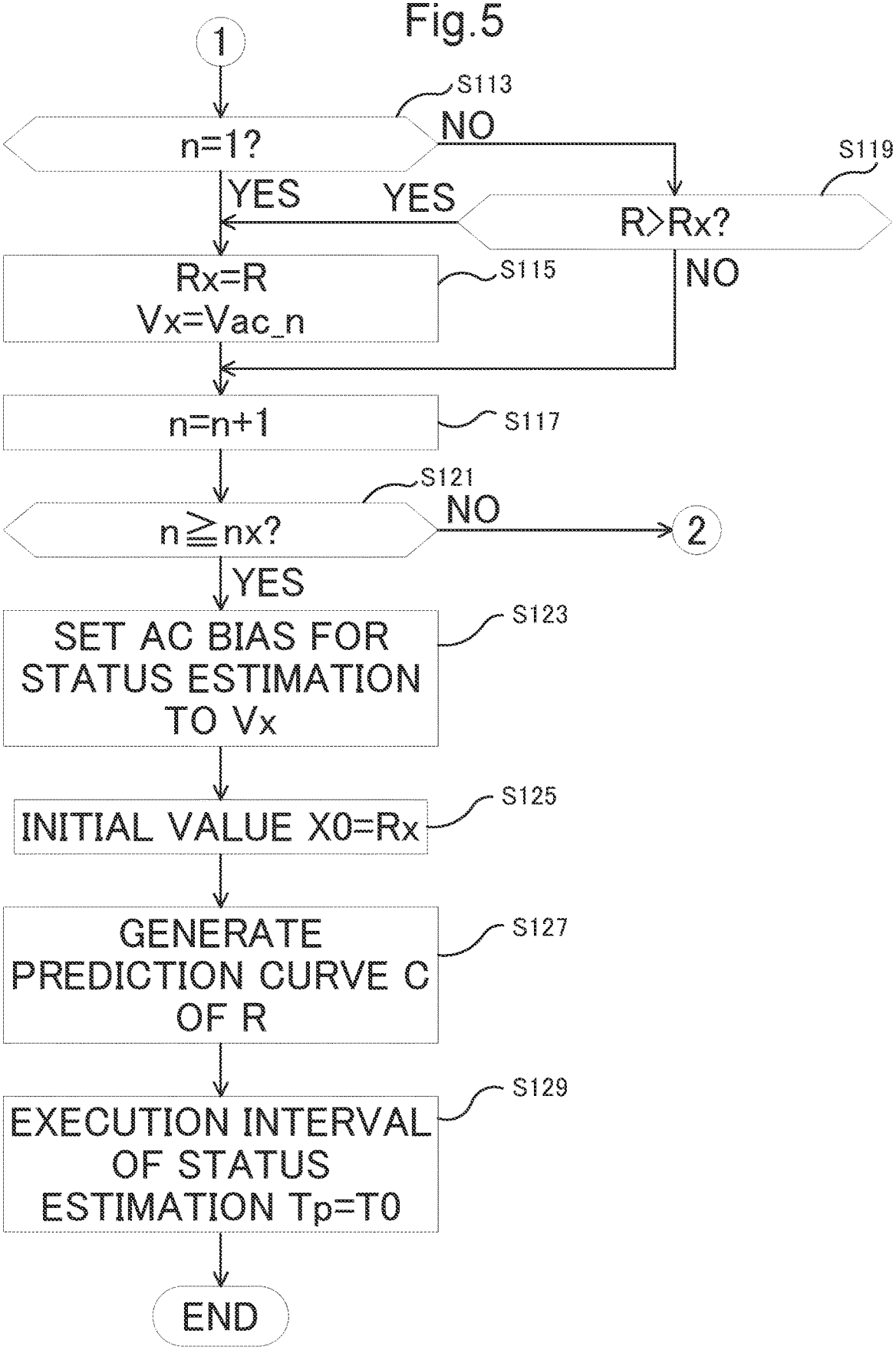
FIG. 5 is a flowchart showing an example of the initialization process.

Referring to FIG. 1 to FIG. 5, an operation performed by the control device 10 will be described. FIG. 4 and FIG. 5 are flowcharts each showing an initialization process, which is an example of the operation performed by the control device 10. The initialization process is performed only once, for example when the image forming apparatus 100 is shipped from the manufacturing plant.

Step S101: As shown in FIG. 4, the control device 10 sets the DC bias Vdc to a first value Vdc1 and a second value Vdc2. Upon completing the operation of step S101, the control device 10 proceeds to step S103.

Step S103: The control device 10 initializes a variable n for controlling an iterative process, to 1. Upon completing the operation of step S103, the control device 10 proceeds to step S105.

Step S105: The control device 10 sets the AC bias to a specific value Vac_n. The specific value Vac_n varies depending on the value of the variable n. Upon completing the operation of step S105, the control device 10 proceeds to step S107.

Step S107: The control device 10 causes the voltage applier 121 to apply the bias to the developing roller 641, and acquires a first magnitude Id1 of the developing current Id corresponding to the bias Vdc1+Vac_n, from the current detector 122. Upon completing the operation of step S107, the control device 10 proceeds to step S109.

Step S109: The control device 10 causes the voltage applier 121 to apply the bias to the developing roller 641, and acquires a second magnitude Id2 of the developing current Id corresponding to the bias Vdc2+Vac_n, from the current detector 122. Upon completing the operation of step S109, the control device 10 proceeds to step S111.

Step S111: The control device 10 calculates the value of the current ratio R, on the basis of the first magnitude Id1 and the second magnitude Id2 of the developing current Id. Here, at step S107 and step S109, the control device 10 controls the exposure device 61, so as to form the electrostatic latent image, representing the rectangular patch pattern having the predetermined area, over the entirety of the photoconductor drum 65 in the axial direction. Upon completing the operation of step S111, the control device 10 proceeds to step S113.

Step S113: As shown in FIG. 5, the control device 10 decides whether the variable n is equal to 1. Upon deciding that the variable n is equal to 1 (Yes at step S113), the control device 10 proceeds to step S115. When the control device 10 decides that the variable n is not equal to 1 (No at step S113), the control device 10 proceeds to step S119.

Step S115: The control device 10 stores the value of the current ratio R calculated at step S111 in the storage device 11, as a maximum value Rx. In addition, the control device 10 stores the specific value Vac_n of the AC bias Vac, used at step S107 and step S109, in the storage device 11 as an optimum value Vx. Upon completing the operation of step S115, the control device 10 proceeds to step S117.

Step S117: The control device 10 updates the value of the variable n, by adding 1. Upon completing the operation of step S117, the control device 10 proceeds to step S121.

Step S119: The control device 10 decides whether the value of the current ratio R calculated at step S111 is larger than the maximum value Rx. Upon deciding that the value of the current ratio R is larger than the maximum value Rx (Yes at step S119), the control device 10 proceeds to step S115, so that the maximum value Rx is updated. When the control device 10 decides that the value of the current ratio R is equal to or smaller than the maximum value Rx (No at step S119), the control device 10 proceeds to step S117.

Step S121: The control device 10 decides whether the value of the variable n is equal to or larger than a threshold nx. Upon deciding that the value of the variable n is equal to or larger than the threshold nx (Yes at step S121), the control device 10 proceeds to step S123. When the control device 10 decides that the value of the variable n is smaller than the threshold nx (No at step S121), the control device 10 returns to step S105.

Step S123: The control device 10 sets the value of the AC bias Vac, to be used for estimating the deterioration status of the cleaning blade 661, to the optimum value Vx. The optimum value Vx corresponds to the specific value Vac_n of the AC bias Vac that maximizes the value of the current ratio R, as described with reference to the operation from step S103 to step S121. While the optimum value Vx is being searched, the first value Vdc1 and the second value Vdc2 of the DC bias Vdc are maintained. Upon completing the operation of step S123, the control device 10 proceeds to step S125.

Step S125: The control device 10 stores the maximum value Rx of the current ratio R stored at step S115 in the storage device 11, as an initial value X0. Upon completing the operation of step S125, the control device 10 proceeds to step S127.

Step S127: The control device 10 generates the prediction curve C representing the predicted change with time, of the value of the current ratio R. Upon completing the operation of step S127, the control device 10 proceeds to step S129.

Step S129: The control device 10 sets the value of an execution interval Tp of the status estimation, to an initial value T0. Upon completing the operation of step S129, the control device 10 finishes the initialization process.

Figure 6:
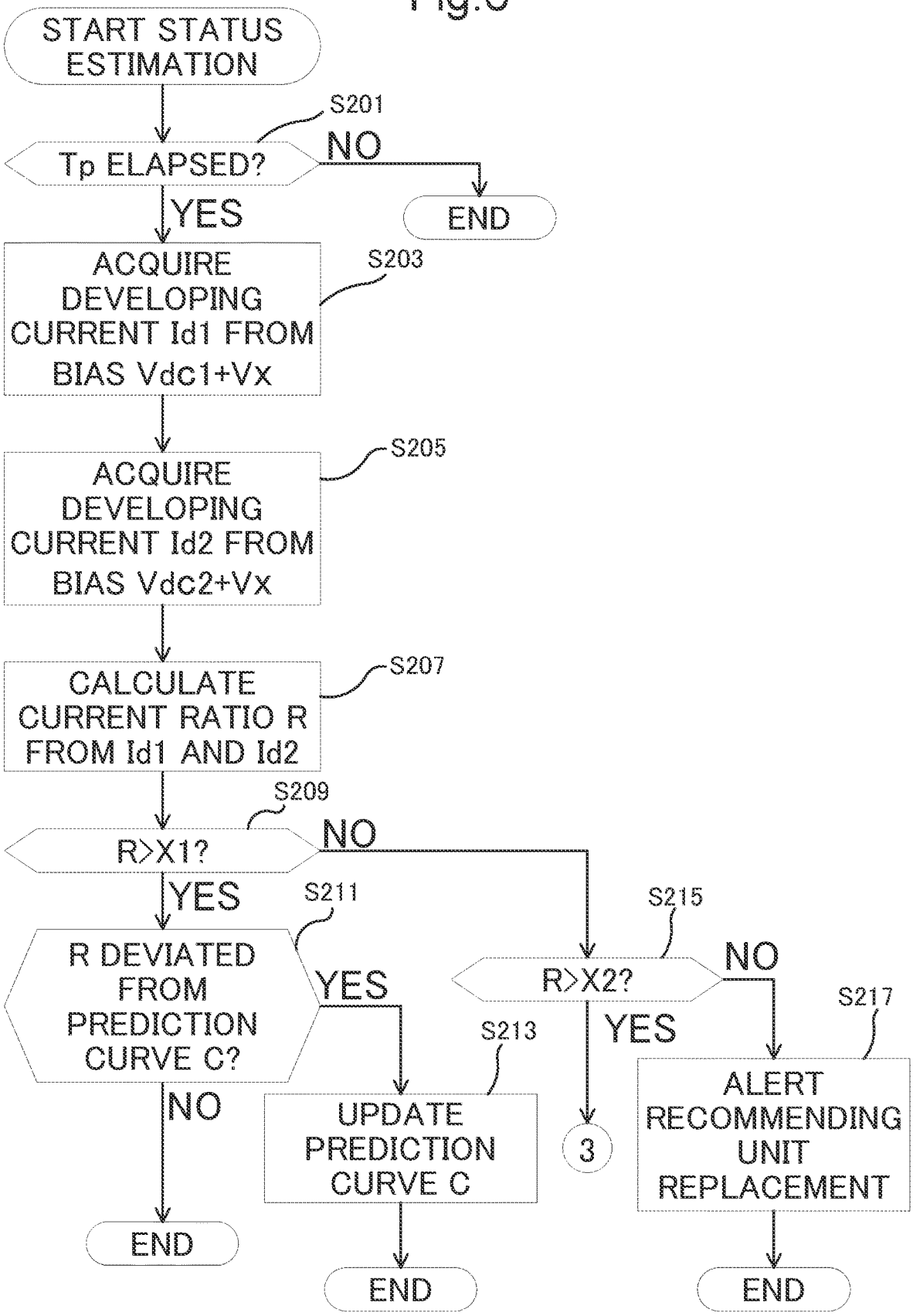
FIG. 6 is a flowchart showing an example of a status estimation process.
Figure 7:
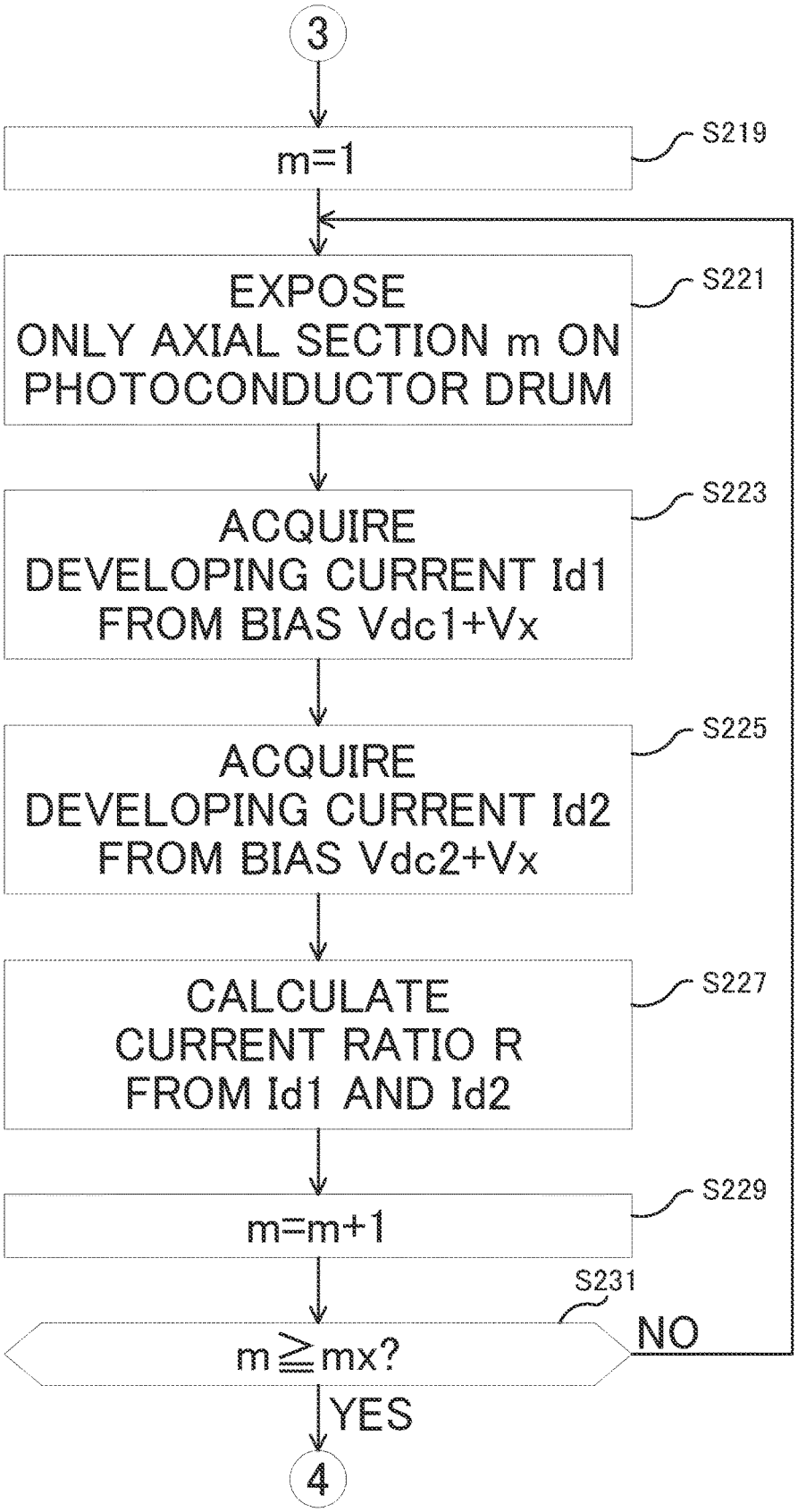
FIG. 7 is a flowchart showing an example of the status estimation process.
Figure 8:
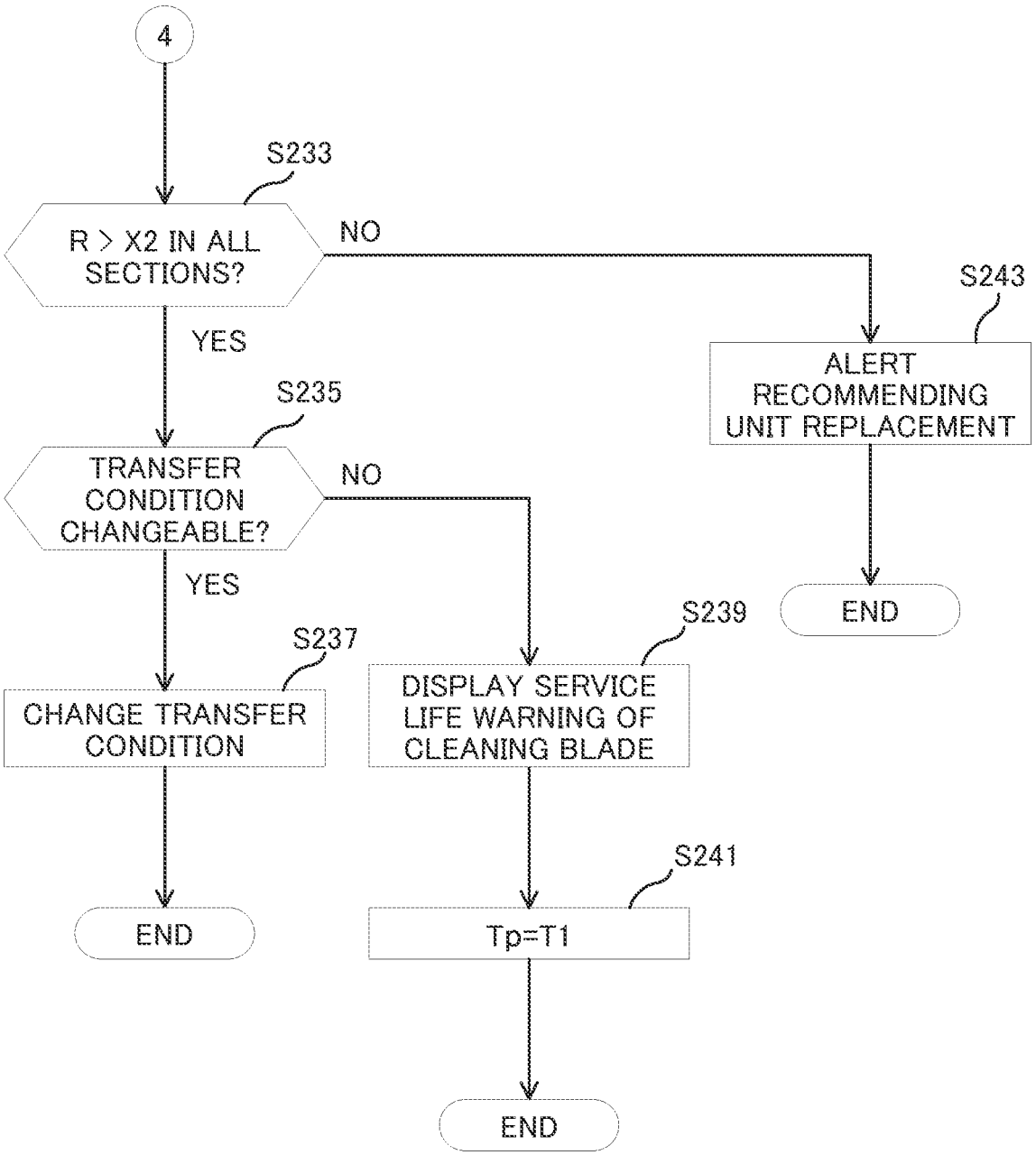
FIG. 8 is a flowchart showing an example of the status estimation process.

Referring to FIG. 1 to FIG. 8, further description will be given regarding the operation performed by the control device 10. FIG. 6, FIG. 7, and FIG. 8 are flowcharts each showing a status estimation process, which is another example of the operation performed by the control device 10.

Step S201: As shown in FIG. 6, the control device 10 decides whether the execution interval Tp of the status estimation has elapsed. Upon deciding that the execution interval Tp of the status estimation has elapsed (Yes at step S201), the control device 10 proceeds to step S203. In contrast, when the control device 10 decides that the execution interval Tp of the status estimation has not elapsed yet (No at step S201), the control device 10 finishes the status estimation process.

Step S203: The control device 10 causes the voltage applier 121 to apply the bias to the developing roller 641, and acquires the first magnitude Id1 of the developing current Id corresponding to the bias Vdc1+Vx, from the current detector 122. Upon completing the operation of step S203, the control device 10 proceeds to step S205.

Step S205: The control device 10 causes the voltage applier 121 to apply the bias to the developing roller 641, and acquires the second magnitude Id2 of the developing current Id in the bias Vdc2+Vx, from the current detector 122. Upon completing the operation of step S205, the control device 10 proceeds to step S207.

Step S207: The control device 10 calculates the value of the current ratio R, on the basis of the first magnitude Id1 and the second magnitude Id2 of the developing current Id. Here, at step S203 and step S205, the control device 10 controls the exposure device 61, so as to form the electrostatic latent image, representing the rectangular patch pattern having the predetermined area, over the entirety of the photoconductor drum 65 in the axial direction. Upon completing the operation of step S207, the control device 10 proceeds to step S209.

Step S209: The control device 10 decides whether the value of the current ratio R calculated at step S207 is larger than the first threshold X1. Upon deciding that the value of the current ratio R is larger than the first threshold X1 (Yes at step S209), the control device 10 proceeds to step S211. When the control device 10 decides that the value of the current ratio R is equal to or smaller than the first threshold X1 (No at step S209), the control device 10 proceeds to step S215.

Step S211: The control device 10 decides whether the value of the current ratio R calculated at step S207 is deviated from the prediction curve C. Upon deciding that the value of the current ratio R is deviated from the prediction curve C (Yes at step S211), the control device 10 proceeds to step S213. In contrast, when the control device 10 decides that the value of the current ratio R is not deviated from the prediction curve C (No at step S211), the control device 10 finishes the status estimation process.

Step S213: The control device 10 updates the prediction curve C, so as to accord with the value of the current ratio R calculated at step S207. Upon completing the operation of step S213, the control device 10 finishes the status estimation process.

Step S215: The control device 10 decides whether the value of the current ratio R calculated at step S207 is larger than the second threshold X2 (<X1). Upon deciding that the value of the current ratio R is larger than the second threshold X2 (Yes at step S215), the control device 10 proceeds to step S219 shown in FIG. 7. It is when the value of the current ratio R satisfies an inequality X2<R≤X1, that the control device 10 proceeds to step S219. When the control device 10 decides that the value of the current ratio R is equal to or smaller than the second threshold X2 (No at step S215), the control device 10 proceeds to step S217.

Step S217: The control device 10 outputs an alert recommending replacement of the unit including the cleaning blade 661, to the user through the LCD 21. Upon completing the operation of step S217, the control device 10 finishes the status estimation process.

Step S219: As shown in FIG. 7, the control device 10 initializes a variable m for controlling an iterative process, to 1. Upon completing the operation of step S219, the control device 10 proceeds to step S221.

Step S221: The control device 10 controls the exposure device 61, so as to form the electrostatic latent image, representing the rectangular patch pattern having the predetermined area, only on a section m of the photoconductor drum 65 in the axial direction. To check whether the cleaning blade 661 is partially damaged, the control device 10 virtually divides the photoconductor drum 65, for example into eight sections, in the Y-direction. Upon completing the operation of step S221, the control device 10 proceeds to step S223.

Step S223: The control device 10 causes the voltage applier 121 to apply the bias to the developing roller 641, and acquires the first magnitude Id1 of the developing current Id corresponding to the bias Vdc1+Vx, from the current detector 122. Upon completing the operation of step S223, the control device 10 proceeds to step S225.

Step S225: The control device 10 causes the voltage applier 121 to apply the bias to the developing roller 641, and acquires the second magnitude Id2 of the developing current Id corresponding to the bias Vdc2+Vx, from the current detector 122. Upon completing the operation of step S225, the control device 10 proceeds to step S227.

Step S227: The control device 10 calculates the value of the current ratio R, on the basis of the first magnitude Id1 and the second magnitude Id2 of the developing current Id. Upon completing the operation of step S227, the control device 10 proceeds to step S229.

Step S229: The control device 10 updates the value of the variable m, by adding 1. Upon completing the operation of step S229, the control device 10 proceeds to step S231.

Step S231: The control device 10 decides whether the value of the variable m is equal to or larger than a threshold mx. Upon deciding that the value of the variable m is equal to or larger than the threshold mx (Yes at step S231), the control device 10 proceeds to step S233 shown in FIG. 8. When the control device 10 decides that the value of the variable m is smaller than the threshold mx (No at step S231), the control device 10 returns to step S221. For example, when the photoconductor drum 65 is divided into eight sections in the Y-direction, the control device 10 sets the threshold mx to 9.

Step S233: As shown in FIG. 8, the control device 10 decides whether the value of the current ratio R repeatedly calculated at step S227 is larger than the second threshold X2, in all the sections of the photoconductor drum 65. Upon deciding that value of the current ratio R is larger than the second threshold X2 in all the sections (Yes at step S233), the control device 10 proceeds to step S235. When the control device 10 decides that the value of the current ratio R is equal to or smaller than the second threshold X2 in any of the sections (No at step S233), the control device 10 proceeds to step S243. Here, the second threshold X2 related to step S215, and the second threshold X2 related to step S233 may be different from each other.

Step S235: The control device 10 decides whether it is possible to change a transfer condition of the transfer device 7, so as to compensate the decline in performance of the cleaning blade 661. Upon deciding that it is possible to change the transfer condition (Yes at step S235), the control device 10 proceeds to step S237. When the control device 10 decides that the transfer condition is unable to be changed (No at step S235), the control device 10 proceeds to step S239.

Step S237: The control device 10 changes the transfer condition of the transfer device 7. Upon completing the operation of step S237, the control device 10 finishes the status estimation process.

Step S239: The control device 10 outputs a warning about the service life of the cleaning blade 661, to the user through the LCD 21. Upon completing the operation of step S239, the control device 10 proceeds to step S241.

Step S241: The control device 10 changes the value of the execution interval Tp of the status estimation, to a predetermined value T1 (T1<T0). In other words, the control device 10 determines the next status estimation timing of the cleaning blade 661, on the basis of the prediction curve C. Upon completing the operation of step S241, the control device 10 finishes the status estimation process.

Step S243: The control device 10 outputs the alert recommending replacement of the unit including the cleaning blade 661, to the user through the LCD 21. Upon completing the operation of step S243, the control device 10 finishes the status estimation process.

Through the status estimation process shown in FIG. 6 to FIG. 8, the control device 10 calculates the current ratio R with respect to each of the plurality of sections of the photoconductor drum 65, when the value of the current ratio R, calculated with respect to the entirety of the photoconductor drum 65, is equal to or smaller than the first threshold X1. The control device 10 compares between the value of the current ratio R of each of the plurality of sections, and the second threshold X2 smaller than the first threshold X1. When the value of the current ratio R is larger than the second threshold X2 in all of the plurality of sections, the control device 10 outputs the warning about the service life of the cleaning blade 661. In contrast, when the value of the current ratio R is equal to or smaller than the second threshold X2 in any of the plurality of sections, the control device 10 recommends the replacement of the cleaning blade 661. Thus, either the service life warning of the cleaning blade 661, or the alert recommending the unit replacement is provided to the user, depending on the value of the current ratio R.

Working Example 1

Hereunder, a working example of the disclosure will be described. The driving condition, the bias condition, and the toner condition for the working example are specified below. However, the disclosure is not limited to the following working example.

[Driving Condition]

Printing speed: 60 sheets/min.

Drum circumferential velocity: 280 mm/sec.

Developing agent carrier linear velocity: 504 mm/sec.

[Bias Condition]

Developing DC bias: −110 V to 130 V

Developing AC bias: 1000 Vpp/1200 Vpp

Developing AC frequency: 8000 Hz

Developing AC duty ratio: 50%

Potential difference between drum and developing agent carrier (Vdc−V0): −130V to 110V

[Toner Condition]

Toner particle diameter: 6.8 μm

Toner polarity: Positive

Figure 9:
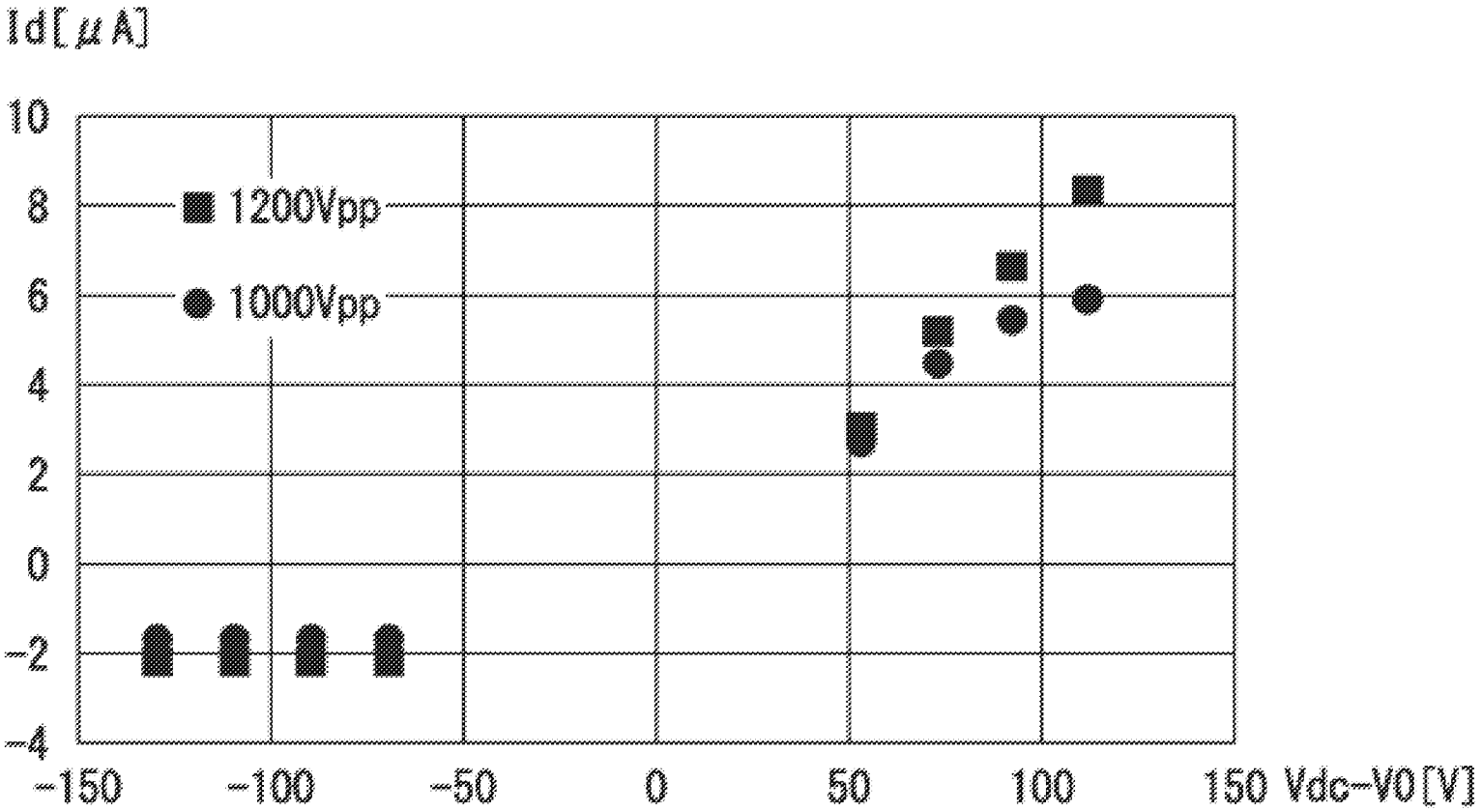
FIG. 9 is a graph showing an example of a correlation between a DC bias and a developing current.

Referring to FIG. 9, a correlation between the DC bias Vdc and the developing current Id in this working example will be described. FIG. 9 is a graph showing an example of the correlation between the DC bias Vdc and the developing current Id. In FIG. 9, the horizontal axis represents the potential difference (Vdc−V0) [V] between the developing roller 641 and the photoconductor drum 65, and the vertical axis represents the developing current Id [μA].

FIG. 9 is a graph showing a measurement result obtained when the cleaning blade 661 is not deteriorated yet. In a range of the DC bias Vdc indicating a forward bias (Vdc−V0>0), the positively charged toner flying from the developing roller 641 to the photoconductor drum 65 increases, with the increase of the DC bias Vdc, and therefore the positive developing current Id increases. On the other hand, in a range of the DC bias Vdc indicating the reverse bias (Vdc−V0<0), the negatively charged toner or carrier flies from the developing roller 641 to the photoconductor drum 65, and therefore the negative developing current Id appears. However, the absolute value of the developing current Id corresponding to the reverse bias is smaller than that of the developing current Id corresponding to the forward bias.

According to FIG. 9, the DC bias Vdc is set as Vdc1−V0=110V, and Vdc2−V0=−130V in the initialization process. When V0 is 20V Vdc1 is 130V and Vdc2 is −110V. When the value of the AC bias Vac is 1000 Vpp under such condition of the DC bias, the value of the current ratio R was 3.57. When the value of the AC bias Vac is 1200 Vpp under the same condition of the DC bias, the value of the current ratio R was 3.89. Therefore, the optimum value Vx of the AC bias Vac is set to 1200Vpp. The initial value X0 of the current ratio R is 3.89.

Figure 10:
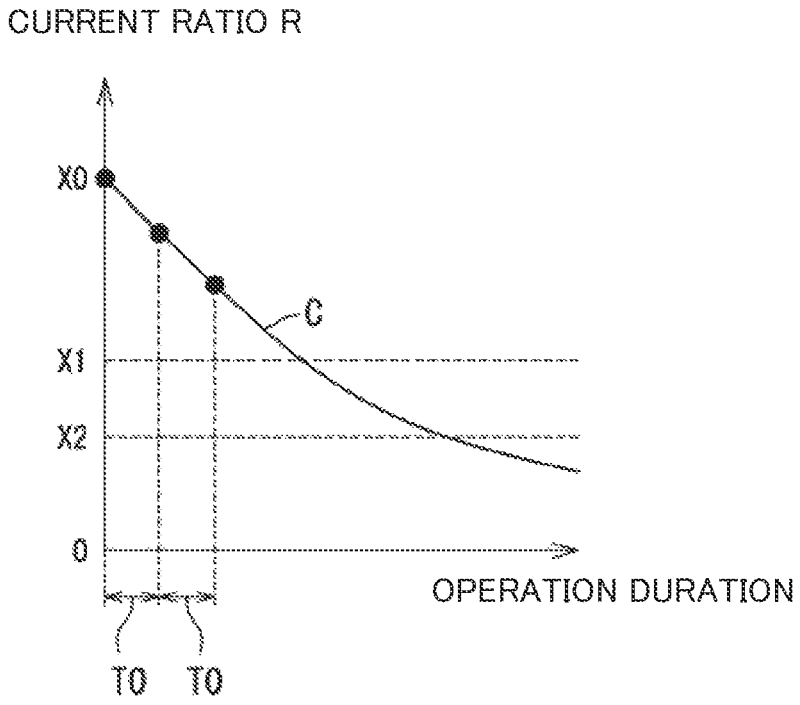
FIG. 10 is a graph showing an example of a prediction curve of a current ratio.

Referring to FIG. 10, the prediction curve C will be described hereunder. FIG. 10 is a graph showing an example of the prediction curve C of the value of the current ratio R. In FIG. 10, the horizontal axis represents the operation duration of the image forming apparatus 100, and the vertical axis represents the value of the current ratio R.

As shown in FIG. 10, the value of the current ratio R at the operation duration "0" is the initial value X0. As long as the value of the current ratio R is not deviated from the prediction curve C, the control device 10 executes the status estimation process shown in FIG. 6 to FIG. 8, each time the initial value T0 of the execution interval Tp of the status estimation elapses. Thereafter, when the cleaning blade 661 is deteriorated to such an extent that the value of the current ratio R satisfies the inequality $X2<R\leq X1$, the service life warning is provided to the user. When the cleaning blade 661 is further deteriorated to such an extent that the value of the current ratio R satisfies an inequality $R\leq X2$, the alert recommending the unit replacement is provided to the user. The first threshold X1 and the second threshold X2 may be set, for example, so as to satisfy $X1=0.5X0$ and $X2=0.3X0$ respectively, on the basis of the initial value X0 of the current ratio R.

Now, the aforementioned existing image forming apparatus is unable to detect a decline in slipperiness of the cleaning blade as a whole. Besides, an increase in the number of positions where the slipperiness of the cleaning blade has declined leads to an increase in toner consumption.

With the configuration according to the foregoing embodiment, in contrast, the image forming apparatus 100, capable of estimating the deterioration status of the cleaning blade 661, can be obtained.

The embodiment of the disclosure has been described as above, with reference to the drawings. However, the disclosure is not limited to the foregoing embodiment, but may be implemented in various manners without departing from the scope of the disclosure. The plurality of constituent elements disclosed in the foregoing embodiment may be combined as desired, to achieve various inventions. For example, some constituent elements may be excluded, from those disclosed in the foregoing embodiment. The drawings each schematically illustrate the essential constituent elements for the sake of clarity, and the thickness, the length, and the number of pieces of each of the illustrated constituent elements may differ from the actual ones, depending on the convenience in making up the drawings. Further, the material, the shape, and the dimensions of the constituent elements described in the foregoing embodiment are merely exemplary, and may be modified in various manners without substantially departing from the effects expected from the present invention.

Although the image forming apparatus 100 is exemplified by the color printer in the foregoing embodiment, the disclosure is not limited thereto. The image forming apparatus 100 may be any apparatus that forms an image using the electrophotography technique.

Although the two-component developing agent is employed as the developing agent in the foregoing embodiment, the disclosure is not limited thereto. The developing agent may be a one-component developing agent.

INDUSTRIAL APPLICABILITY

The disclosure is applicable to the technical field of the image forming apparatus.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

an image carrier that carries an electrostatic latent image;

a developing device including a developing agent carrier that carries a developing agent at least containing toner;

a voltage applier that applies a bias voltage including a DC bias and an AC bias to the developing agent carrier, to cause the toner to migrate from the developing agent carrier to the image carrier;

a current detector that measures developing current flowing between the developing agent carrier and the image carrier;

a cleaning blade located in contact with the image carrier, to remove residual toner on the image carrier after a toner image is transferred; and a control device including a processor, and configured to act, when the processor executes a control program, as:

a measurer that changes the DC bias to a first value and a second value, and acquires a first magnitude of the developing current corresponding to the first value, and a second magnitude of the developing current corresponding to the second value, from the current detector; and an estimator that calculates a current ratio between the first magnitude and the second magnitude, and estimates deterioration status of the cleaning blade, according to a value of the current ratio.

2. The image forming apparatus according to claim 1, wherein the estimator changes a value of the AC bias, thereby acquiring a specific value of the AC bias that makes the current ratio maximum, and sets the AC bias to be used for the deterioration status estimation, to the specific value.

3. The image forming apparatus according to claim 1, wherein the estimator generates a prediction curve indicating a predicted change with time of the value of the current ratio, and determines a next status estimation timing of the deterioration status of the cleaning blade, on a basis of the prediction curve.

4. The image forming apparatus according to claim 3, wherein the estimator updates the prediction curve, when the value of the current ratio, obtained after generating the prediction curve, is deviated from the prediction curve.

5. The image forming apparatus according to claim 1, wherein the estimator compares between the value of the current ratio and a first threshold, and divides, when the value of the current ratio is equal to or smaller than the first threshold, the image carrier into a predetermined number of sections in an axial direction calculates, the measurer changes the DC bias to the first value and the second value and acquires the first magnitude and the second magnitude from the current detector, with respect to each of the sections, and the estimator calculates the current ratio with respect to each of the sections, compares between the value of the current ratio of each of the sections and a second threshold smaller than the first threshold, and recommends replacement of the cleaning blade, when the value of the current ratio is equal to or smaller than the second threshold in any of the sections.

6. The image forming apparatus according to claim 5, wherein the estimator keeps from recommending the replacement, when the value of the current ratio is larger than the first threshold.

7. The image forming apparatus according to claim 1, wherein the estimator compares between the value of the current ratio and a first threshold, and divides, when the value of the current ratio is equal to or smaller than the first threshold, the image carrier into a predetermined number of sections in an axial direction calculates, the measurer changes the DC bias to the first value and the second value and acquires the first magnitude and the second magnitude from the current detector, with respect to each of the sections, and the estimator calculates the current ratio with respect to each of the sections, compares between the value of the current ratio of each of the plurality of sections and a second threshold smaller than the first threshold, and outputs a warning about a service life of the cleaning blade, when the value of the current ratio is larger than the second threshold in all of the sections.

8. The image forming apparatus according to claim 7, further comprising a transfer device that transfers the toner image formed on a surface of the image carrier to a recording medium, wherein the estimator outputs the warning about the service life of the cleaning blade, when the value of the current ratio is larger than the second threshold in all of the plurality of sections and when a transfer condition of the transfer device is unable to be changed, and changes the transfer condition, provided that it is possible to change the transfer condition.

9. The image forming apparatus according to claim 7, wherein the estimator keeps from outputting the warning, when the value of the current ratio is larger than the first threshold.

* * * * *